US005772193A

United States Patent [19]

Dykstra

[11] Patent Number: 5,772,193

[45] Date of Patent: Jun. 30, 1998

[54] DOUBLE SUPPORTED PLUNGER CLAMP

[75] Inventor: Henry Dykstra, Milford, Mich.

[73] Assignee: Delaware Capital Formation, Inc., Birmingham, Mich.

[21] Appl. No.: 707,343

[22] Filed: Sep. 3, 1996

[51] Int. Cl.[6] ..... B25B 1/14

[52] U.S. Cl. ..... 269/228

[58] Field of Search ..... 269/228, 32, 282

[56] References Cited

U.S. PATENT DOCUMENTS 2,574,281 11/1951 Olson ..... 269/228

5,346,194 9/1994 Coffin ..... 269/228

5,373,642 12/1994 Supe-Dienes ..... 269/228

*Primary Examiner*—Robert C. Watson

*Attorney, Agent, or Firm*—Dinnin & Dunn, P.C.

[57] ABSTRACT

A plunger clamp that provides a positive clamping force in each direction and an over center locking force in each direction, both while providing a low profile relative to the axis of the clamping force when closed in either direction. The clamp has a toggle arm pivotally connected to the plunger support above the axis of the plunger to allow the plunger to clamp at each end of its stroke, without requiring a 180° rotation of the handle.

16 Claims, 3 Drawing Sheets

FIG. 4.
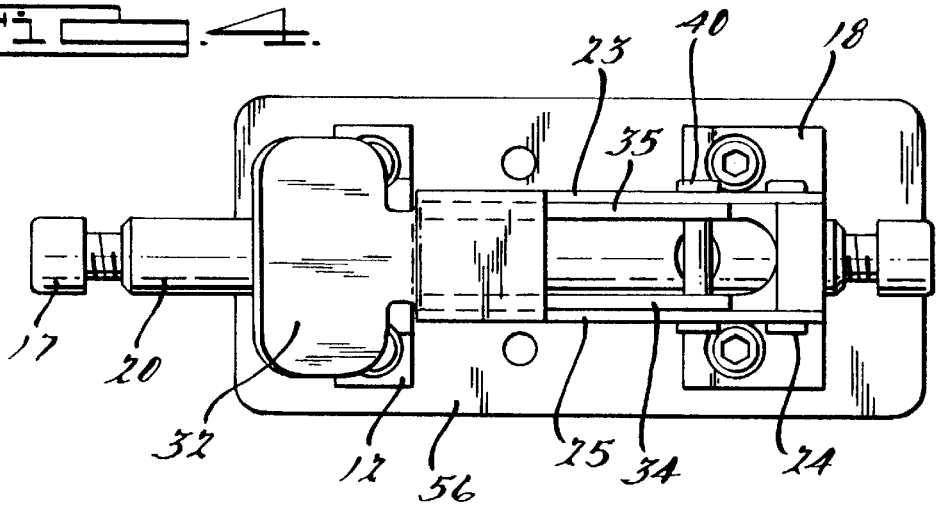
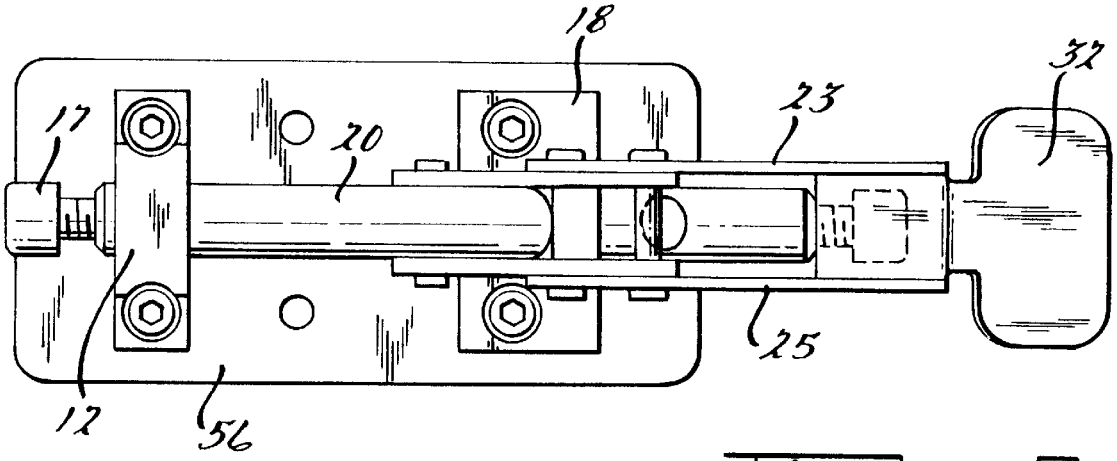
FIG. 5.
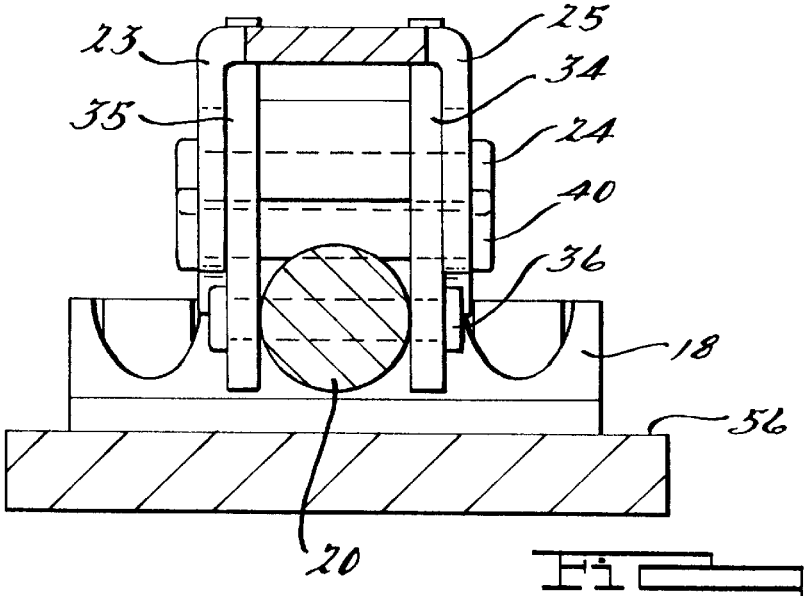
FIG. 6.

DOUBLE SUPPORTED PLUNGER CLAMP

FIELD OF THE INVENTION

The present invention broadly relates to a plunger clamp apparatus, and more particularly, relates to a low profile plunger clamp assembly wherein the plunger can be locked in either a closed or open position.

BACKGROUND OF THE INVENTION

Plunger or toggle clamps have been long known in the industry which provide a lever arm connected through a linkage to move a cylindrical plunger into a locking position. The linkage generally consists of a pivot point for the lever arm which is on the plane of the motion of the plunger and a pivot point where the linkage is attached to the plunger which is by definition also on the same plane. The third part of the linkage, the pivot point connecting the lever arm to the driving linkage, rotates generally about the pivot point of the lever arm and either aligns with the other two pivot points when the clamp is in the clamping position, or goes slightly past the plane of the other two pivot points, creating an over-center or locking position. Such plunger clamping devices often require an additional locking mechanism such as a releasable locking latch to prevent the clamp mechanism from opening. An example of this type of mechanism and clamping device is shown in U.S. Pat. No. 5,165,418 to Fleischer, et al. Such devices provided clamping force at only one end of the plunger, and in the closed position have a lever arm protruding well above the clamping axis of the plunger. The handle for this clamp must travel a full 180°, which typically requires the handle to be lowered past the clamping plane to generate a locking force in the pull clamping position. Further, prior art mechanisms utilize a forged base which is difficult and expensive to manufacture, which have only a single support for the plunger and which necessarily are limited to one particular clamp size.

The present invention provides a plunger-type clamp which provides positive clamping force in each direction, which provides an over-center locking force in each direction and yet which provides a low profile relative to the axis of the clamping force when closed in either direction. Further, the present invention provides two separate supports for the plunger and utilizes a base which may be machined from stainless steel.

Wherefore, it is an object of the present invention to provide a design of a plunger clamp with a low profile relative to the axis of the clamping source.

Another object of the invention is to provide a toggle clamp which does not require a full 180° rotation of the handle to lock for clamping in each direction of the travel of the handle.

Another object of the present invention is to provide a design of a plunger clamp having a base that may be easily machined and which supports the plunger at two separate points.

Still another object of the invention is to provide a design of a plunger clamp capable of clamping in two directions.

Another object of the invention is to provide a design of the plunger apparatus that is capable of locking the plunger without a locking latch.

Additional objects, advantages and novel features of the invention will be set forth in part in the description which follows, and in part will become apparent to those skilled in the art upon examination of the following or may be learned by practice of the invention. The objects and the advantages of the invention may be realized and obtained by means of the instrumentalities and combinations particularly pointed out in the appended claims.

SUMMARY OF THE INVENTION

According to the present invention, the foregoing and other objects and advantages are obtained by a plunger clamp with two of three pivotal connections positioned above the longitudinal axis of a plunger allowing the plunger to have two ends extending from opposing sides of a support to provide two clamping forces in the direction of each end. Angled drive arms allow the plunger clamp to be locked over-center in each clamping direction with a toggle lever resting substantially parallel and just above the plunger to create a low profile clamp in the two locked over-center positions.

BRIEF DESCRIPTION OF THE DRAWINGS

FIG. 4 is a top view of the present invention with the plunger clamped in the first locked position.

FIG. 5 is a top view of the present invention similar to FIG. 4 with the plunger clamped in the second locked position.

FIG. 6 is a sectional view of FIG. I along lines 6—6.

DESCRIPTION OF THE PREFERRED EMBODIMENT(S) AND BEST MODE OF CARRYING OUT THE INVENTION

Figure 1:
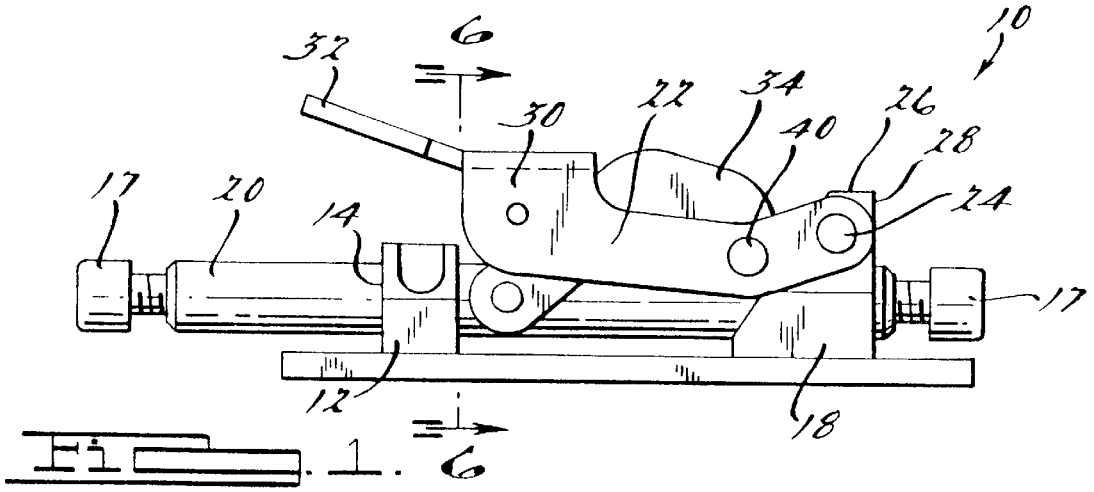
FIG. 1 is a side view of the present invention with the plunger clamped in the first locked position.

Referring now in greater detail to the drawings, FIG. 1 illustrates a plunger clamp 10 in accordance with the present invention including a first support 12 having a first linear bearing 14 aligned with a second linear bearing 16 of a second support 18. An elongated plunger 20 is slidably held and supported within the two aligned bearings 14, 16, said plunger 20 having ends capable of receiving threaded adjustment knobs 17 to adjust the throw of said plunger clamp 10. A toggle lever 22 is pivotally connected to the top portion of the second support 18 at cross pin 24, the top portion forming a shoulder 26. The opposite end of the toggle lever 22 forms a handle 30 with a flange 32 integrally extending slightly upward from the handle. Cooperating between the plunger 20 and toggle lever 22 is a pair of drive arms 34 and 35 pivotally connected to the plunger 20 by a cross pin 36 and pivotally connected to the toggle lever 22 by a cross pin 40.

Flange 32 allows for convenient finger (or thumb) engagement to rotatably move the toggle lever 22 about cross pin 24 to actuate drive arm 34 which drives the plunger 20 along a longitudinal axis. With reference to FIGS. 4–6, said toggle lever 22 includes two lever arms 23 and 25 forming an opening through which the upper portions of the drive arms 34 and 35 extend as the toggle lever 22 is manipulated to the first locked position. This cooperation allows the toggle lever 22 to be lowered toward the plunger 20 past the drive arms, establishing a plunger clamp apparatus with a low profile. The plunger 20 has a first concave detent 42 with an axis perpendicular to the longitudinal axis of the plunger which receives a portion of the cross pin 40 when the plunger is in the first locked position, further increasing the locking force and increasing the downward travel of the toggle lever 22. Support 18 has a concave surface 43 with an axis perpendicular to the longitudinal axis of the plunger to permit full travel of the drive arms 34 and 35. In this position, the plunger 20 is locked in a push position.

Figure 2:
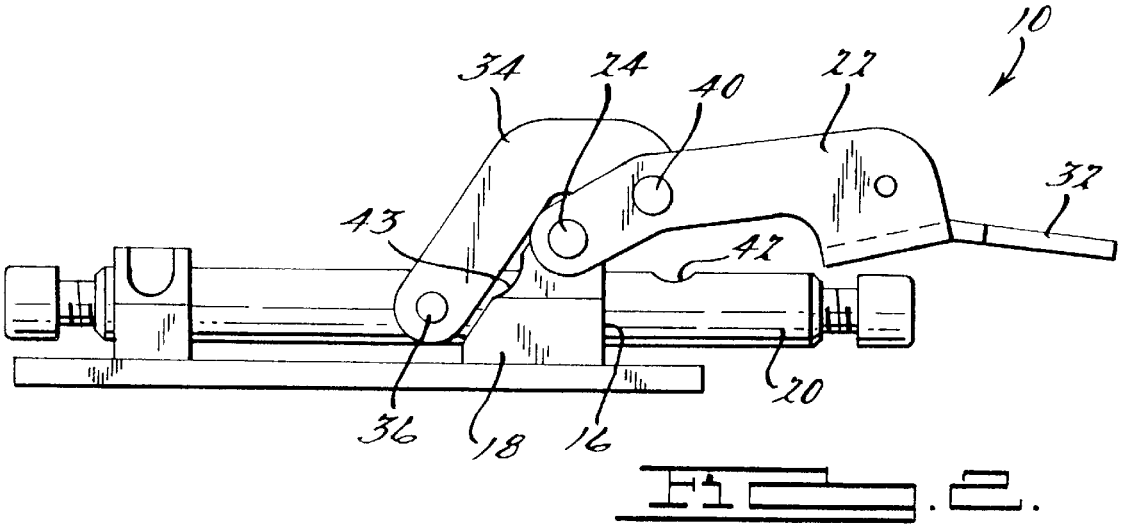
FIG. 2 is a view similar to FIG. 1 showing the plunger in a clamped second locked position.

Actuation of the toggle lever 22 about the axis of cross pin 24 from the first locked position (FIG. 1) translates the axis of cross pin 40 from a point beneath the plane defined by the first axis and a third axis of the cross pins 36 and 24 through a path above and past a new plane defined by the axes of cross pins 36 and 24 in the second locked position as illustrated in FIG. 2. The travel is reversed when the toggle lever is returned to the first locked position. Thus, the plunger generates a clamping force at each end of its stroke, and the linkage locks in an over-center position at each end of the stroke.

FIG. 2 is the same view of the present invention as FIG. 1 with the toggle lever 22 rotated about the first axis of cross pin 24 into the second locked position. In this position, the drive arm 34 rests on shoulder 26 of the second support 18 engaging the back 28 of the second support 18 to increase the locking force on the plunger 20.

Figure 3:
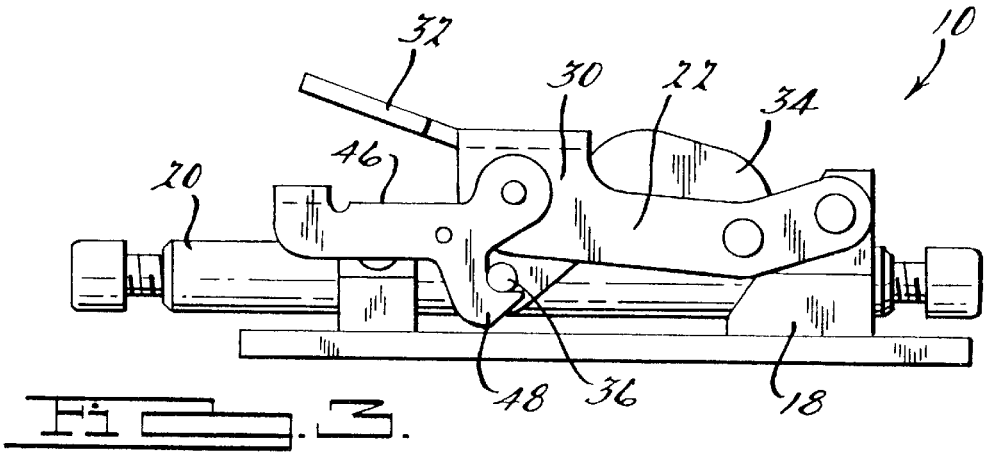
FIG. 3 is a view similar to FIG. 1 where the plunger is clamped closed and safety locked by a safety latch element.

FIG. 3 illustrates the invention with a safety latch 46 pivotally connected to handle 30 with latch knob 48 engaging cross pin 36 to lock the plunger 20 in the first locked position.

Figure 7:
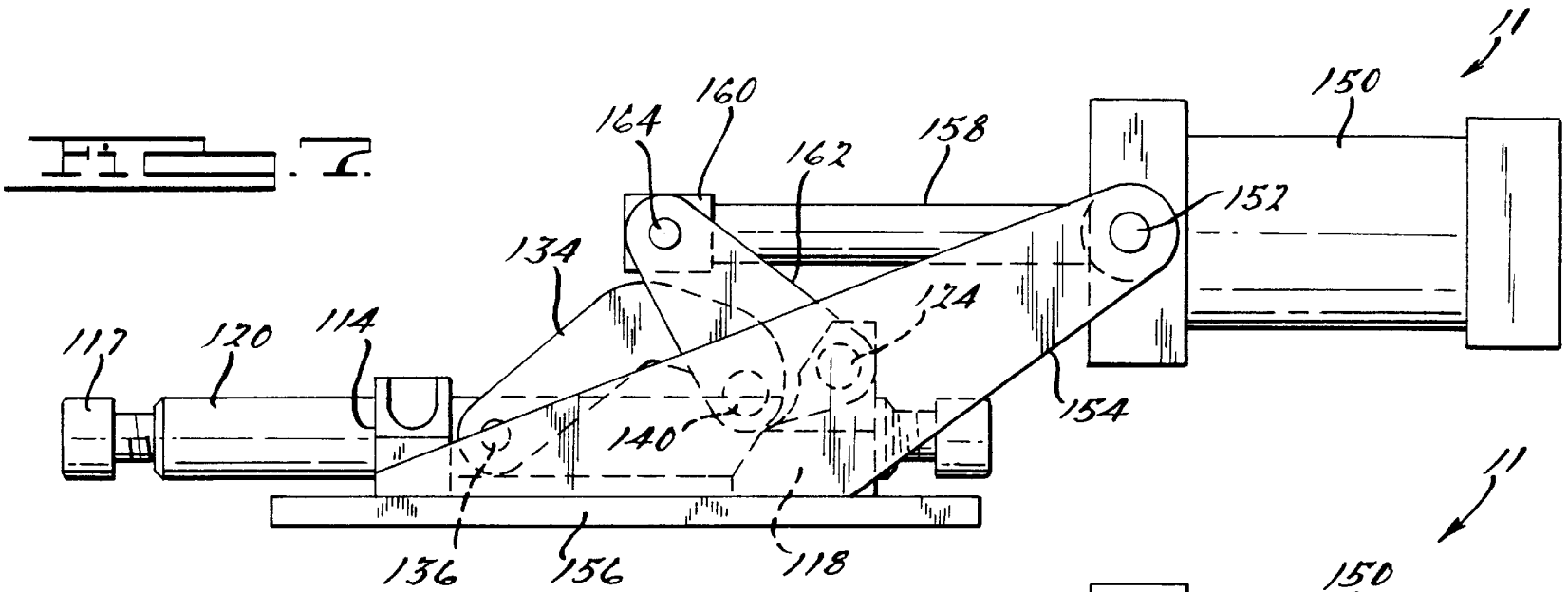
FIG. 7 is a second embodiment of the present invention incorporating a pneumatic source activating the plunger in a closed position.
Figure 8:
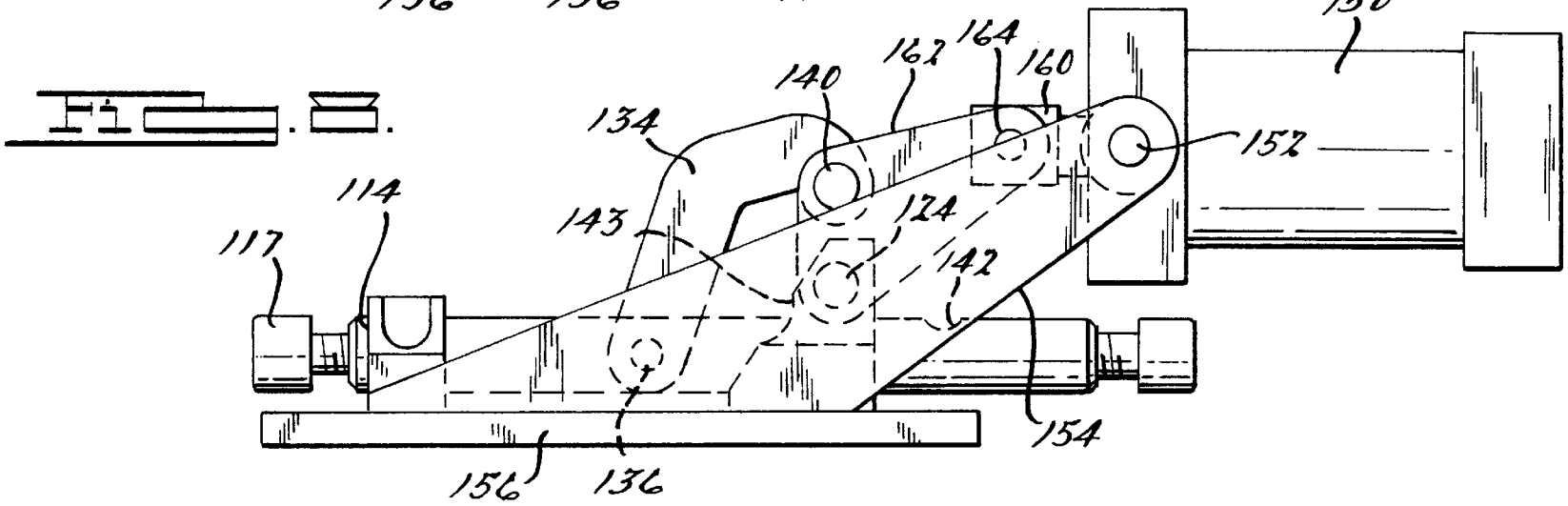
FIG. 8 is similar to the view in FIG. 7 with a pneumatic source clamping the plunger in an open position.

A second embodiment 11 of the invention is illustrated in FIGS. 7 and 8. The parts corresponding to the first embodiment share the same reference numeral with the addition of the prefix 1. Thus, the plunger of FIG. 1 (20) is labeled 120 in FIG. 7. FIG. 7 illustrates a pneumatic source having a cylinder 150 pivotally supported at cross pin 152 by side flange 154 affixed to a base 156, a piston rod 158 extending from the cylinder 150, and a rod end 160 integral to the piston rod 158. A triangular toggle link 162 is used in place of the toggle lever 22, but the operation is similar to the previous embodiment. The toggle link 162 is pivotally connected at all three corners, to the piston rod end 160 at cross pin 164, to the locking arm 134 at cross pin 140, and to the second support 118 at cross pin 124. Upon actuating cylinder 150 to extend piston rod 158, engagement of rod end 160 with toggle link rotates the locking arm 134 past center to once again lock the plunger 120 in a closed/push position. When the cylinder is retracted, the plunger 120 is returned to a closed position.

As illustrated in FIGS. 4 and 5, a base 56 is provided with three pairs of mounting holes strategically spaced so that either the present invention 10 may be secured to the base using bolts as shown, or a single support single-throw plunger clamp of the type of the prior art (not shown) may be affixed to said base using the same pair of mounting holes as the support 18 and the intermediate set of mounting holes.

What is claimed is:

1. A plunger clamp comprising:

at least one support;

an elongated plunger slidably held within said support, said plunger having two ends extending from opposite sides of said support;

at least one toggle lever pivotally connected to said support above said plunger establishing a first pivotal axis;

at least one drive arm having a first pivotal connection to said toggle lever establishing a second pivotal axis, said drive arm including a second pivotal connection to said plunger establishing a third pivotal axis, said drive arm translating the angular motion of said toggle lever to drive said plunger along a longitudinal axis between first and second locked positions responsive to movement of said toggle lever, said plunger in each position having one end providing a push force while the other end provides a pull force.

2. The plunger clamp of claim 1 wherein said toggle lever rotates less that 180° between said first and second positions.

3. The plunger clamp of claim 1 further comprising a second support aligned with first support wherein said plunger is slidably held within a pair of supports in the first and second positions.

4. The plunger clamp of claim 1 wherein said first locked position is a locked over-center position established by the second pivotal axis positioned below a first plane established by the first and third pivotal axes with said second pivotal axis on the same side of the support as the pivotal connection with the plunger, said second locked position is a locked over-center position established by the second pivotal axis positioned below a second plane established by the first and third pivotal axes with said second pivotal axis on the opposite side of the support as the pivotal connection with the plunger.

5. The plunger clamp of claim 4 wherein said toggle lever in said first and second locked positions is substantially parallel to said longitudinal axis and in close proximity above said plunger.

6. The plunger clamp of claim 3 wherein said supports are machined from stainless steel.

7. The plunger clamp of claim 1 wherein said drive arm is an angled member having an edge contoured to rest against said support to halt movement of the plunger with the second pivotal axis below a plane established by the first and third pivotal axes locking the plunger in an over-center position.

8. The plunger clamp of claim 2 further comprising a means for safety locking said toggle lever in said first locked position, said safety locking means comprises a safety latch pivotally connected to said toggle lever, said safety latch further comprising a cross pin pivotally connecting said drive arm and said plunger, said safety latch having an extension for releasably receiving said cross pin.

9. The plunger clamp of claim 1 further comprising a cross pin pivotally connecting said toggle lever and said drive arm, said plunger having a concave detent receiving a portion of said cross pin when said toggle lever is in said first locked position.

10. The plunger clamp of claim 4 wherein said pivotal connections are cross pins.

11. The plunger clamp of claim 1 wherein said plunger includes at least one threaded adjustment knob.

12. A plunger clamp comprising:

at least one support;

an elongated plunger slidably held within said support, said plunger having two ends extending from opposite sides of said support;

at least one drive arm pivotally connected to said plunger establishing a first pivotal axis;

at least one toggle lever having a first pivotal connection to said support above said plunger establishing a second pivotal axis, said toggle lever including a second pivotal connection to said drive arm establishing a third pivotal axis, said toggle lever rotates between a first locked position through a path to a second locked position, said plunger responsive to the motion of said toggle lever.

13. The plunger clamp of claim 12 wherein said drive arm is an angled member having an edge contoured to rest against said support to halt movement of the plunger with the third pivotal axis below a plane established by the first and second pivotal axes in an over-center locked position.

14. The plunger clamp of claim 12 further comprising a second support aligned with first support wherein said plunger is slidably held within a pair of supports in the first and second positions.

15. The plunger clamp of claim 12 wherein said first locked position is a locked over-center position established by the third pivotal axis positioned below a first plane established by the first and second pivotal axes with said third pivotal axis on the same side of the support as the pivotal connection with the plunger, said second locked position is a locked over-center position established by the third pivotal axis positioned below a second plane established by the first and second pivotal axes with said third pivotal axis on the opposite side of the support as the pivotal connection with the plunger.

16. The plunger clamp of claim 15 wherein said toggle lever in said first and second locked positions is substantially parallel to said longitudinal axis and in close proximity above said plunger.

* * * * *

UNITED STATES PATENT AND TRADEMARK OFFICE

CERTIFICATE OF CORRECTION

PATENT NO. : 5,772,193

DATED : June 30, 1998

INVENTOR(S) : Henry Dykstra

It is certified that error appears in the above-identified patent and that said Letters Patent is hereby corrected as shown below:

Column 2, line 25, delete "closed" and insert -- in first locked position --; and
Column 4, line 1, claim 2, "that" should read -- than --.

Signed and Sealed this

Fifteenth Day of September, 1998

*Attest:*

Bruce Lehman

BRUCE LEHMAN

*Attesting Officer*

*Commissioner of Patents and Trademarks*